US006131628A

United States Patent [19]

Chiang

[11] Patent Number: 6,131,628

[45] Date of Patent: Oct. 17, 2000

[54] WOOD PLANING MACHINE WITH MATERIAL REMOVAL INDICATOR ASSEMBLY

[76] Inventor: Pei-Lieh Chiang, No. 12, Nan-Ping Rd., Nan Dist., Taichung City, Taiwan

[21] Appl. No.: 09/432,501

[22] Filed: Nov. 2, 1999

[51] Int. Cl.[7] ..... B27C 1/00

[52] U.S. Cl. ..... 144/130; 144/117.1

[58] Field of Search ..... 144/114.1, 116, 144/117.1, 129, 130

[56] References Cited

U.S. PATENT DOCUMENTS 5,725,035 3/1998 Shadeck ..... 144/117.1
5,771,949 6/1998 Welsh et al. ..... 144/130

*Primary Examiner*—W. Donald Bray
*Attorney, Agent, or Firm*—Christie, Parker & Hale, LLP

[57] ABSTRACT

A planing machine includes a machine base with two mounting sides and feed-in and take-out sides, and two pairs of upstanding posts that extend upwardly from the mounting sides. A cutter carriage is disposed above the machine base, and is movable along the posts, and has a front side extending in a transverse direction and proximate to the feed-in side, a rear side, and a lowermost surface between said front and rear sides and cooperating with the machine base to define a workpiece passage therebetween. A material removal indicator assembly includes a ball retention groove formed in the cutter carriage and in communication with the workpiece passage, a ball member rotatably and movably disposed in the ball retention groove and having a lowermost protruding area extending outwardly of the ball retention groove and into the workpiece passage, and an uppermost lifting area. The lowermost protruding area and the uppermost lifting area are provided with lowermost and uppermost contact points defining an upright length which remains constant during rotation of the ball member in the retention groove. A pointer has a pivot portion pivotally mounted on the cutter carriage at a level above the ball retention groove, a pointing portion, and an intermediate portion resting on the uppermost contact point of the ball member.

4 Claims, 9 Drawing Sheets

WOOD PLANING MACHINE WITH MATERIAL REMOVAL INDICATOR ASSEMBLY

BACKGROUND OF THE INVENTION

1. Field of the Invention

The invention relates to a wood planing machine, more particularly to a wood planing machine with a material removal indicator assembly that is adapted to indicate in advance the thickness of the portion of a wooden workpiece to be removed when the workpiece is processed.

2. Description of the Related Art

Referring to FIG. 1, a conventional wood planing machine 10 according to U.S. Pat. No. 5,771,949 is shown to include a machine base 11, left and right pairs of upstanding posts 12 (only one post 12 is visible in FIG. 1), a cutter carriage 13, a height adjustment mechanism 14, and a material indicator assembly 30.

As illustrated, the machine base 11 has opposite mounting sides 111 spaced apart from each other in a transverse direction, and opposite feed-in and take-out sides spaced apart from each other in a longitudinal direction. The upstanding posts 12 extend upward from the machine base 11 at the mounting sides 111. The cutter carriage 13 is disposed above the machine base 11, and is connected movably to the upstanding posts 12 for sliding movement of the cutter carriage 13 along the upstanding posts 12. The cutter carriage 13 further has a cutter device (not visible) mounted thereon, a front side 130 proximate to the feed-in side, a rear side opposite to the front side 130, and a lowermost surface between the front and rear sides and extending in the longitudinal direction and cooperating with the machine base 11 to define a workpiece passage between the cutter carriage 13 and the machine base 11 for passage of a workpiece 20 to be planed.

The height adjustment mechanism 14 moves the cutter carriage 13 along the upstanding posts 12 so as to define a desired height of the cutter carriage 13 relative to the machine base 11.

Referring to FIGS. 2 and 3, the material removal indicator assembly 30 includes an indicia 33 with incremental marks fixed on the front sided 130 (see FIG. 1) of the cutter carriage 13, and a pointer 31 having a pivot portion 311 mounted pivotally on the front side 130 and spaced from the indicia 33 in the transverse direction such that the pointer 31 extends in the transverse direction.

The pointer 31 is formed with a workpiece contact block 32 proximate to and below the pivot portion 311. When the cutter carriage 13 is lowered due to operation of the height adjustment mechanism 14, the workpiece contact block 32 will contact the workpiece 20, which action in turn, pivots the pointer 31 about the pivot axis, thereby raising the pointing portion 312 along the indicia 33. Because the contact between the contact block 32 and the workpiece 20 is face-to-face contact, and because the uppermost surface of the workpiece 20 is generally not an even or flat surface, the pointing portion 312 of the pointer 31 is accordingly unable to provide an accurate measure of the thickness of the portion to be removed from the workpiece 20. In addition, constant dragging of the uneven surface of the workpiece 20 against the contact block 32 during the feed-in process may hinder smooth planing of the workpiece 20 and can result in eventual ruin of the material removal indicator assembly after long term use.

SUMMARY OF THE INVENTION

Therefore, the object of the present invention is to provide a wood planing machine which is clear of the aforementioned drawbacks that result from the use of the conventional wood planing machine.

Another object of the present invention is to provide a wood planing machine which has a tool accommodating chamber such that tools for repairing and maintaining the planing machine can be kept in the tool accommodating chamber.

Accordingly, the wood planing machine of the present invention includes a machine base, a plurality of upstanding posts, a cutter carriage, a height adjusting member, and a material removal indicator assembly. The machine base has opposite mounting sides spaced apart from each other in a transverse direction, and feed-in and take-out sides opposite to each other in a longitudinal direction. The upstanding posts extend upwardly from the machine base at the mounting sides. The cutter carriage is disposed above the machine base, and has opposite end portions mounted movably on the upstanding posts for sliding movement of the cutter carriage therealong. The cutter carriage further has a front side extending in the transverse direction and proximate to the feed-in side, a rear side opposite to the front side, and a lowermost surface between the front and rear sides in the longitudinal direction and cooperating with the machine base to define a workpiece passage between the cutter carriage and the machine base. The height adjusting member is disposed to displace the cutter carriage relative to the machine base along the upstanding posts. The material removal indicator assembly includes a ball retention groove formed in the cutter carriage and in communication with the workpiece passage, and a ball member rotatably and movably disposed in the ball retention groove. The ball member has a lowermost protruding area extending outwardly of the ball retention groove and into the workpiece passage, and an uppermost lifting area. The lowermost protruding area and the uppermost lifting area of the ball member are respectively provided with lowermost and uppermost contact points that define an upright length which remains constant during rotation of the ball member relative to the ball retention groove. A pointer has a pivot portion mounted pivotally on the cutter carriage at a level above the ball retention groove, a pointing portion distal to the pivot portion, and an intermediate portion between the pivot and pointing portions and resting on the uppermost contact point of the ball member and applying a downward force on the ball member such that the pointer extends in the transverse direction. An indicia is uprightly disposed on the cutter carriage, and has incremental marks pointed to by the pointing portion of the pointer. After placing a workpiece on the machine base proximate to the feed-in side, the subsequent downward movement of the cutter carriage along the upstanding posts will bring the lowermost contact point to abut against the workpiece which, in turn, exerts a lifting force to the ball member as well as the uppermost lifting area as the downward movement of said cutter carriage continues, thereby pivoting the pointer and moving the pointing portion along the indicia to indicate a thickness value of the portion of the workpiece to be removed when the workpiece is fed through the workpiece passage.

The planing machine further includes left and right side walls extending uprightly from the mounting sides of the machine base, and disposed outboard to the upstanding posts, respectively. At least one of the left and right side walls has an outer surface formed with a tool accommodation chamber. A cover shield is detachably mounted on the side wall so as to shield the tool accommodation chamber and so as to keep the tool accommodation chamber out of sight.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
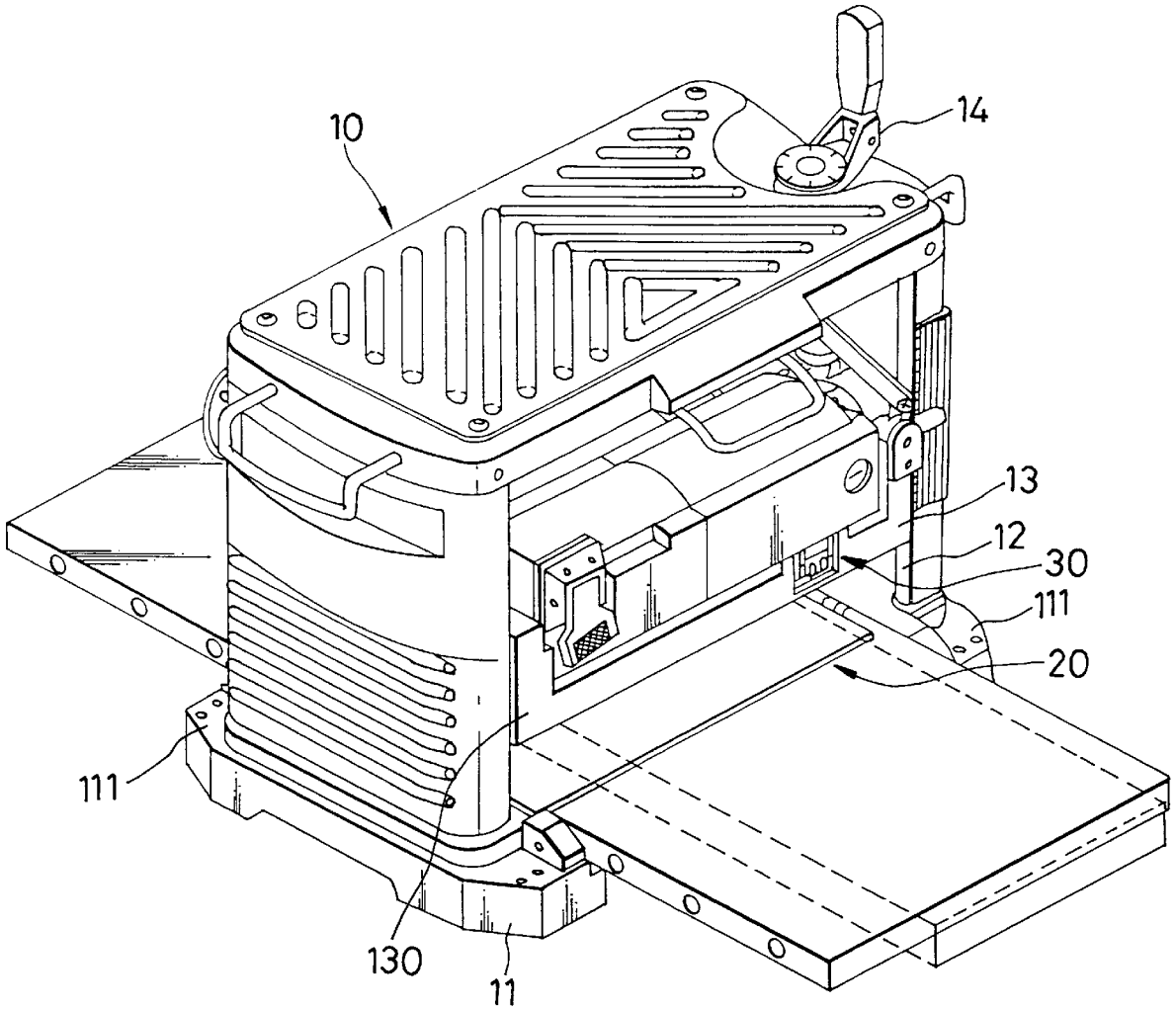
FIG. 1 PRIOR ART
FIG. 1 is a perspective view of a conventional wood planing machine according to U.S. Pat. No. 5,771,949.
Figure 2:
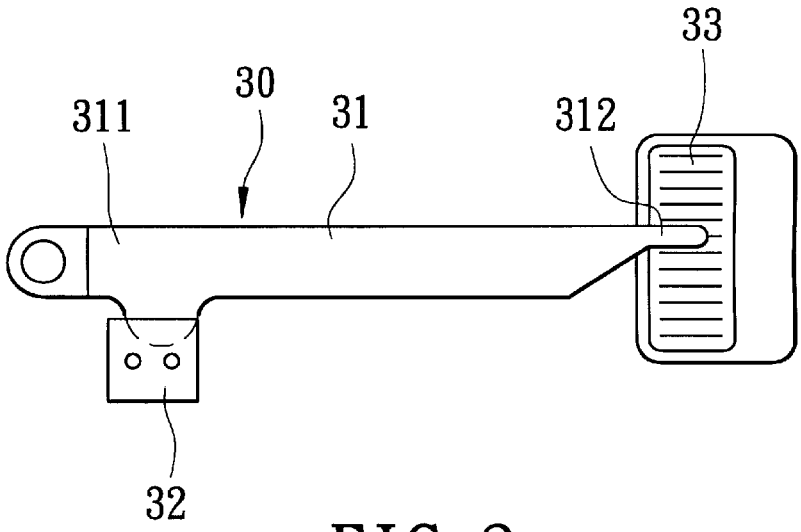
FIG. 2 PRIOR ART
FIGS. 2 and 3 illustrate the operation of a material removal indicator assembly of the conventional wood planing machine.
Figure 3:
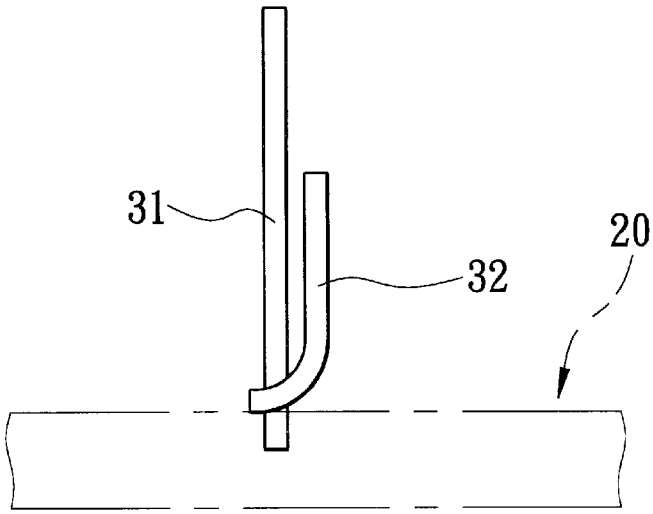
FIG. 3 PRIOR ART
Figure 4:
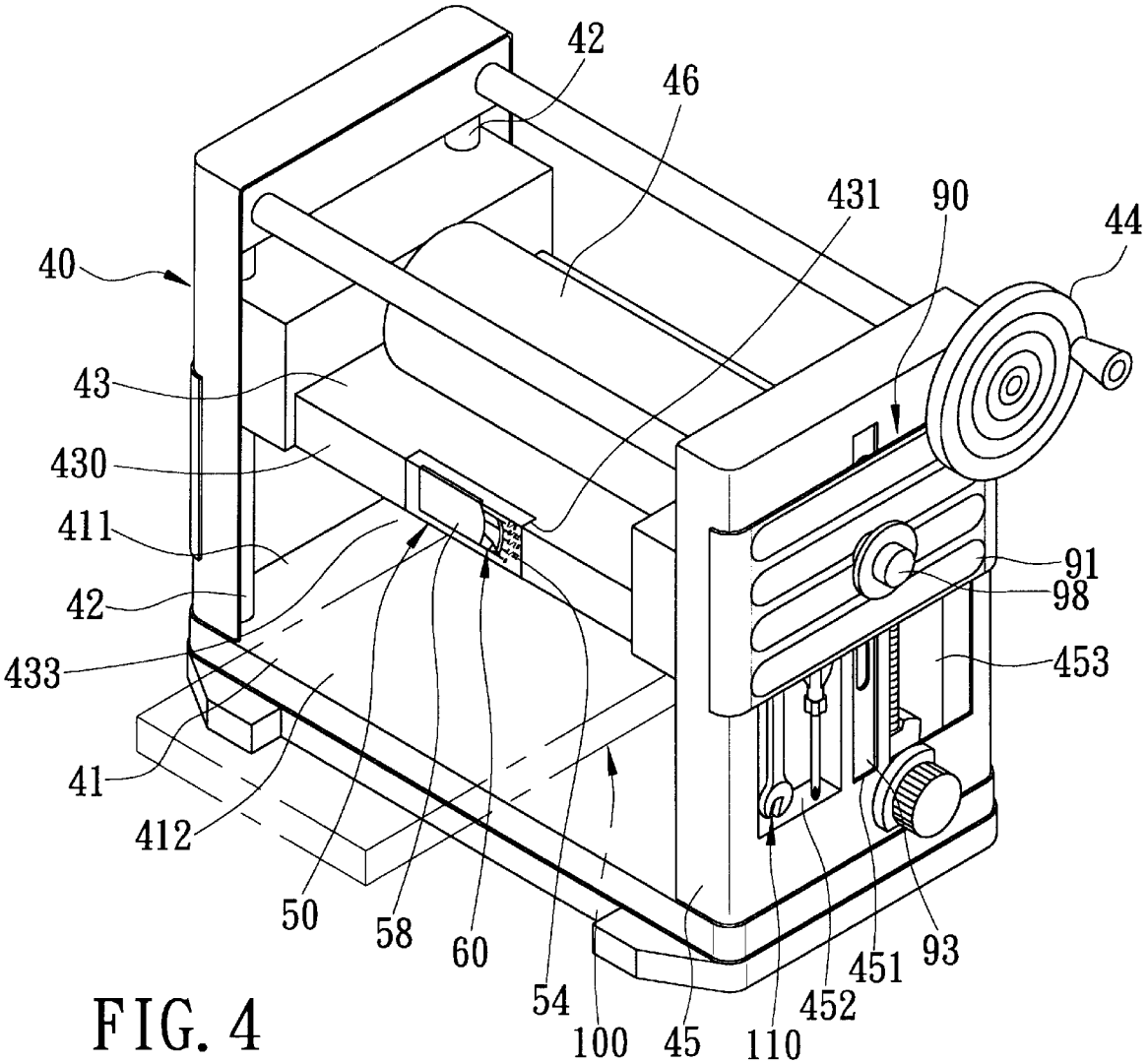
FIG. 4 is a perspective view of the preferred embodiment of a wood planing machine of this invention.
Figure 5:
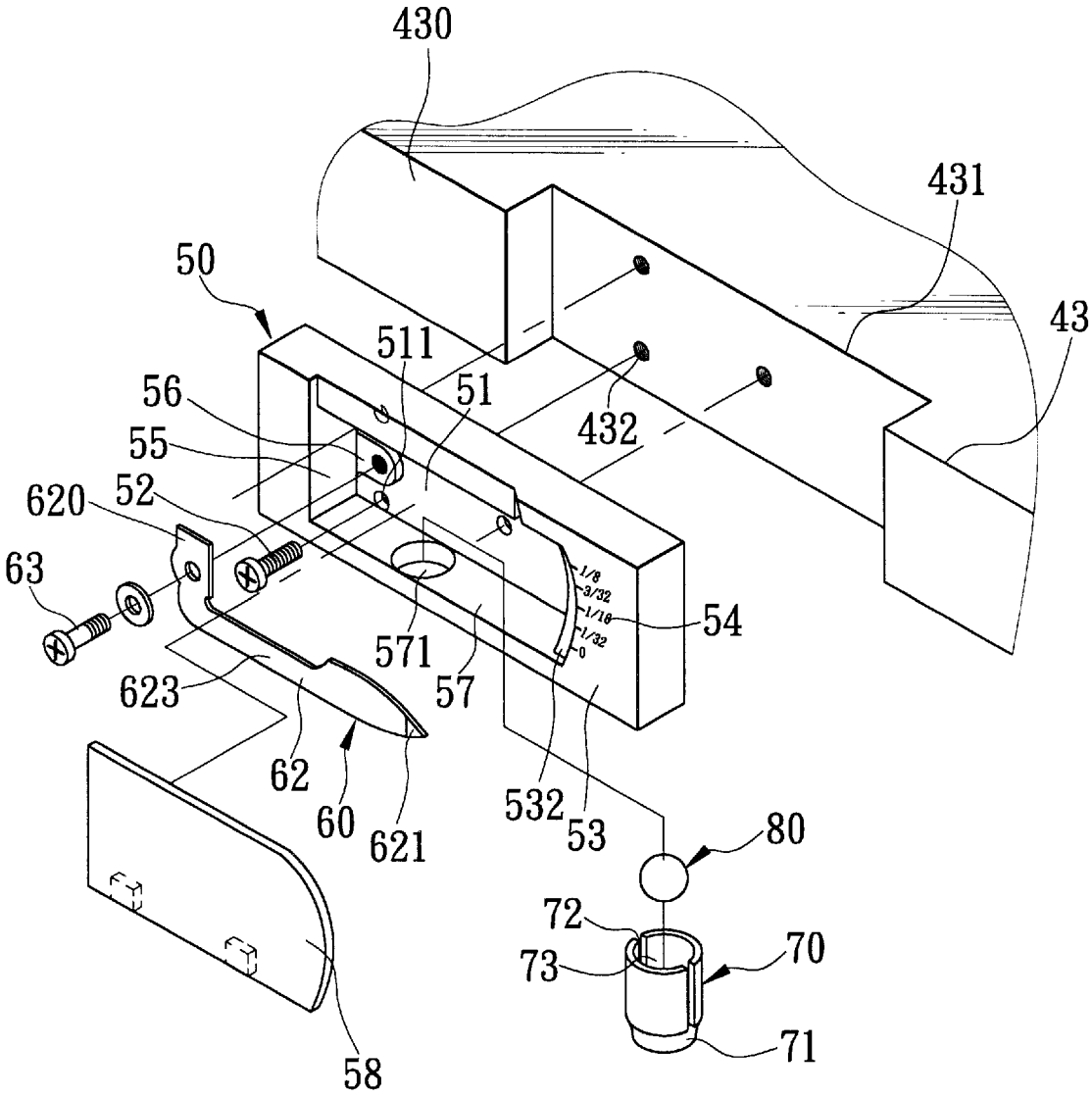
FIG. 5 is an exploded view of a material removal indicator assembly, illustrating how it is mounted on the preferred embodiment.
Figure 6:
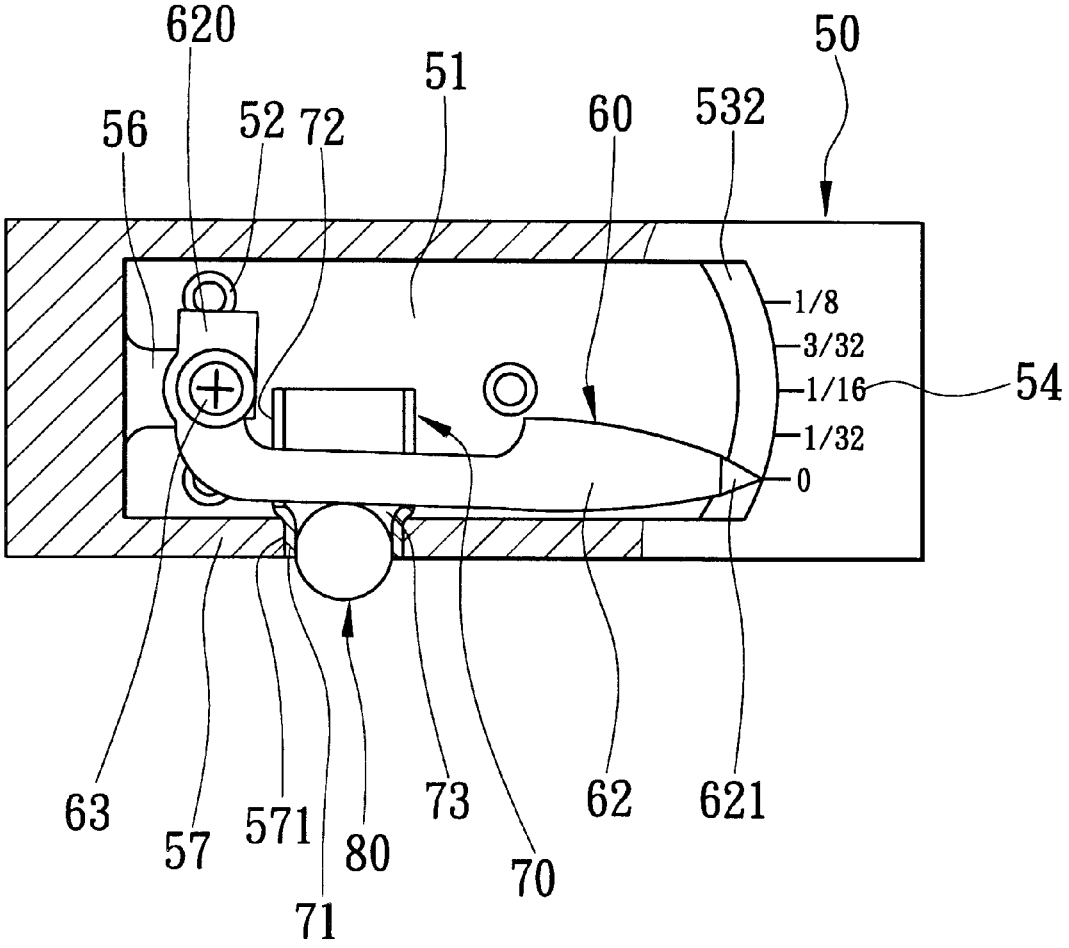
FIG. 6 illustrates a state of the material removal indicator assembly of the preferred embodiment prior to contacting a workpiece.

Referring to FIGS. 4, 5 and 6, the preferred embodiment of a wood planing machine 40 of the present invention is shown to include a machine base 41, a plurality of upstanding posts 42, a cutter carriage 43, a height adjusting mechanism 44, and a material removal indicator assembly 60.

As illustrated, the machine base 41 has opposite mounting sides 411 spaced apart from each other in a transverse direction, and feed-in and take-out sides disposed apart from each other in a longitudinal direction. Left and right pairs of upstanding posts 42 extend upward from the machine base 41 at the mounting sides 411. A cutter carriage 43 is disposed above the machine base 41, and has opposite end portions mounted movably on the upstanding posts 42 for sliding movement of the cutter carriage 43 therealong. As is known in the art, the cutter carriage 43 is adapted for mounting a cutter device 46 and a drive unit (not shown) for driving the cutter device 46 thereon. Since the mounting of the cutter device 46 on the cutter carriage 43 is not pertinent to the present invention, a detailed description thereof is omitted herein for the sake of brevity. The cutter carriage 43 further has a front side 430 extending in the transverse direction and proximate to the feed-in side, a rear side opposite to the front side 430, and a lowermost surface 433 that extends between the front and rear sides in the longitudinal direction and that cooperates with the machine base 41 to define a workpiece passage 412 between the cutter carriage 43 and the machine base 41. The workpiece passage 412 extends in the longitudinal direction.

The height adjusting mechanism 44 is disposed between the machine base 41 and the cutter carriage 43 in a conventional manner, and has a turning wheel that is operated to displace the cutter carriage 43 relative to the machine base 41 along the upstanding posts 42. Since the structure of the height adjusting mechanism 44 is not critical to the present invention, a detailed description thereof will be omitted herein for the sake of brevity.

The material removal indicator assembly 60 includes a rectangular pointer holding seat 50, a pointer 62, a ball member 80, an indicia 54, and a cover member 58. The pointer holding seat 50 is fixed in a seat retention recess 431 in the front side 430 of the cutter carriage 43 by means of fastener screws 52 (only one is shown in FIG. 5) that are threaded through screw holes 511 of the innermost wall 51 in the holding seat 50 and threaded holes 432 in the recess 431. The pointer holding seat 50 has a bottom portion 57 generally flush with the lowermost surface 433 of the cutter carriage 43, and a pointer accommodating space 55 above the bottom portion 57. A ball retention groove 571 is formed through the bottom portion 57 of the holding seat 50 to receive the ball member 80 rotatably therein such that a lowermost protruding area of the ball member 80 extends outwardly of the retention groove and into the workpiece passage 412 while an uppermost lifting area of the ball member 80 extends into the pointer accommodating space 55. The lowermost protruding area and the uppermost lifting area of the ball member 80 are respectively provided lowermost and uppermost contact points that define an upright length which remains constant during rotation of the ball member 80 in the retention groove 571. The pointer 62 has a pivot portion 620 pivoted on a stud 56 of the seat 50 by a pivot screw 63 at a level above the ball retention groove 571, a pointing portion 621 distal to the pivot portion 620, and an intermediate portion 623 between the pivot and pointing portions 620,621. After assembly, the intermediate portion 623 of the pointer 62 rests and applies a downward force on the uppermost contact point of the ball member 80 such that the pointer 62 extends in the transverse direction. The indicia 54 is disposed uprightly on the front side 430 of the cutter carriage 43, and has incremental marks, e.g. 0, 1/32, . . . 3/32, 1/8 inch, pointed to by the pointing portion 621 of the pointer 62. The pointing portion 621 of the pointer 62 generally indicates "0" in a normal state, as best shown in FIG. 6. The cover member 58 is removably mounted on the holding seat 50 so as to shield the accommodating space 55, and has a length in the transverse direction shorter than that of the holding seat 50 and accordingly forms a clearance via which the pointing portion 621 is visible externally of the accommodating space 55.

Figure 7:
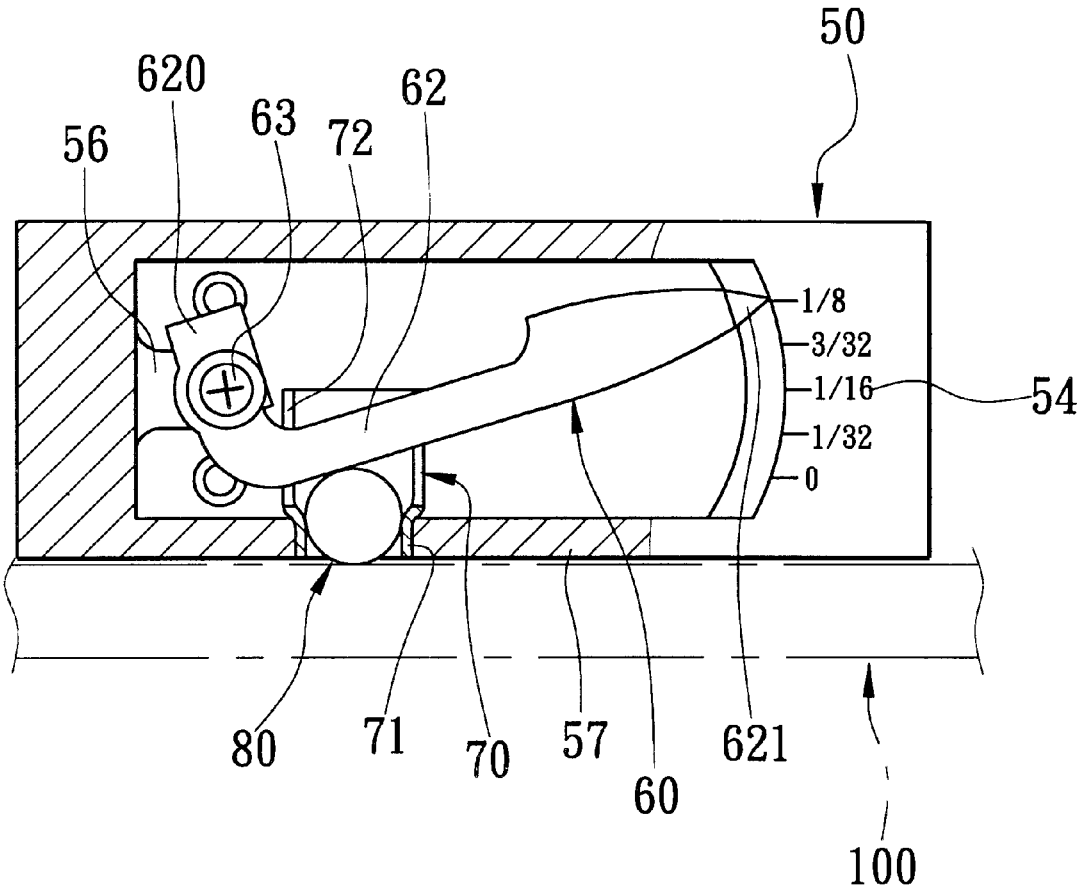
FIG. 7 illustrates a state of the material removal indicator assembly of the preferred embodiment upon contact with the workpiece for indicating the thickness of the portion to be removed from the workpiece.

Referring to FIG. 7, after placing a workpiece 100 on the machine base 41 (see FIG. 4) proximate to the feed-in side, the cutter carriage 43 can be moved downward along the upstanding posts 42 by manually operating the height adjusting mechanism 44 so as to bring the lowermost contact point of the ball member 80 to abut against the workpiece 100 which, in turn, will lift the pointer 62 to pivot about the pivot screw 63, thereby moving the pointing portion 621 along the indicia 54. Upon reading a desired thickness value of the portion of the workpiece 100 to be removed by the cutter device 46, downward movement of the cutter carriage 43 is stopped, and the latter is locked relative to the upstanding posts 42 with the assistance of the height adjusting mechanism 44. After operation of the drive unit (not shown) so as to activate the cutter device 46, the workpiece 100 is fed through the workpiece passage 412 for processing. The ball member 80 contacts the workpiece 100 at the lowermost contacting point and therefore provides optimum accuracy of the thickness of the portion to be removed from the workpiece 100. The ball member 80 rolls over the top surface of the workpiece 100 so as to ensure a smooth planing operation.

Referring again to FIGS. 5 and 7, the material removal indicator assembly 60 further includes a ball holding member 70 formed as a hollow tubular body having a small-diameter section 71 disposed fittingly in the ball retention groove 571 of the holding seat 50 to receive the ball member 80 rotatably therein, and a large-diameter section 73 which extends uprightly from the small-diameter section 71 and which is formed with a diametrically spaced pair of axially extending slots 72 for extension of the intermediate portion 623 of the pointer 62 therethrough in such a manner that the latter rests on the uppermost contact point of the ball member 80. The pointer holding seat 50 preferably has an outer surface 53 flush with the front side of the cutter carriage 43, and a sliding support member 532 disposed in the pointer accommodating space 55 adjacent to the indicia 54 to support sliding movement of the pointing portion 621 of the pointer 62.

Figure 8:
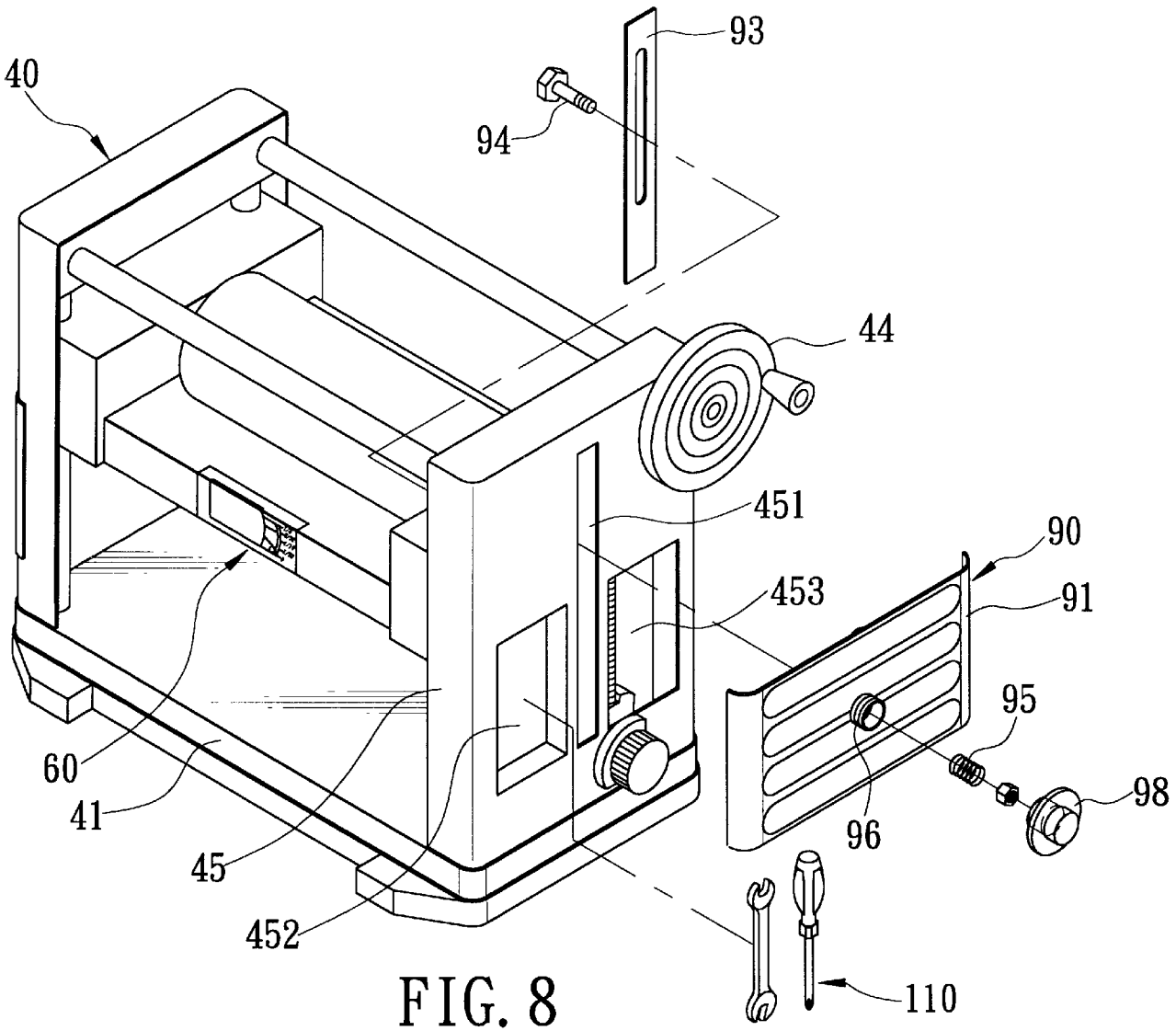
FIG. 8 is a partly exploded view of the preferred embodiment.
Figure 9:
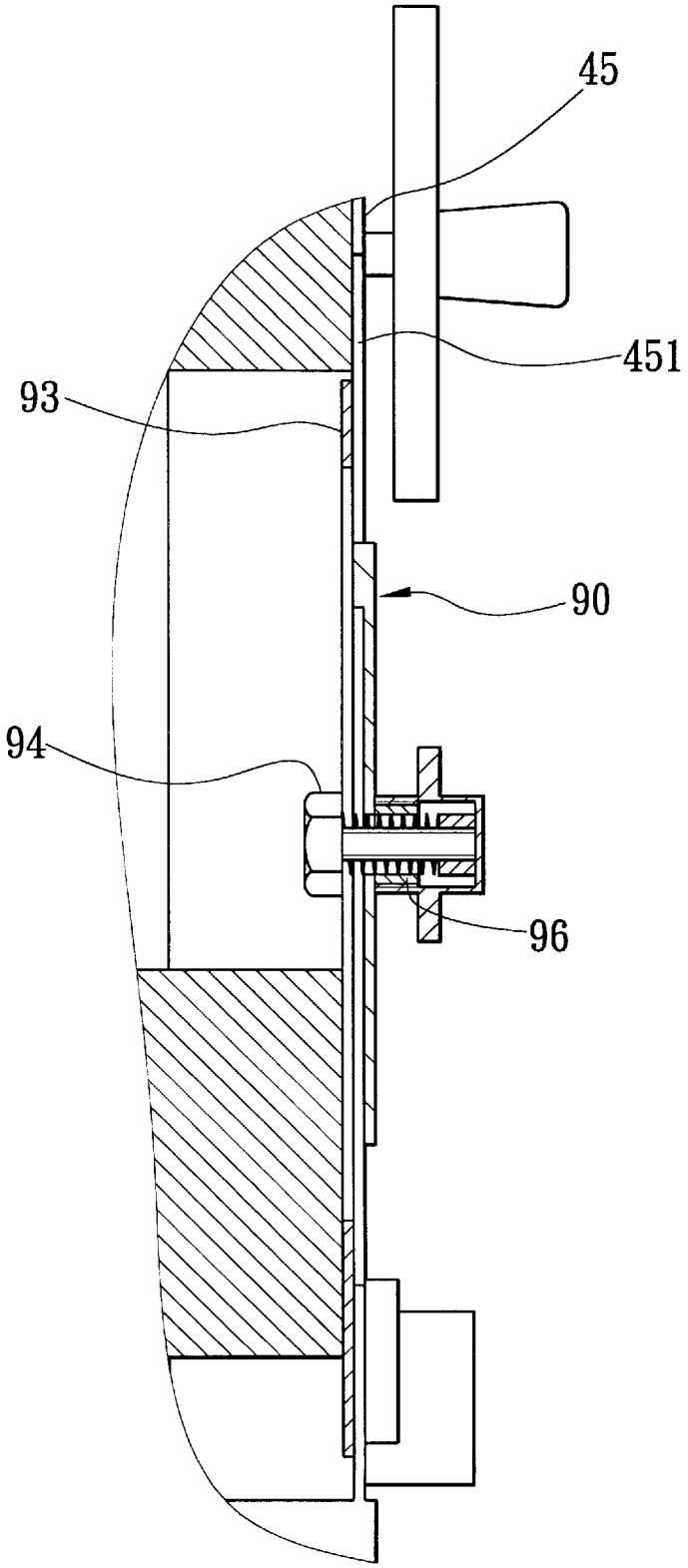
FIG. 9 is a fragmentary sectional view of the preferred embodiment, illustrating how a cover shield is detachably mounted on a side wall in order to shield a tool accommodating chamber formed in the side wall.
Figure 10:
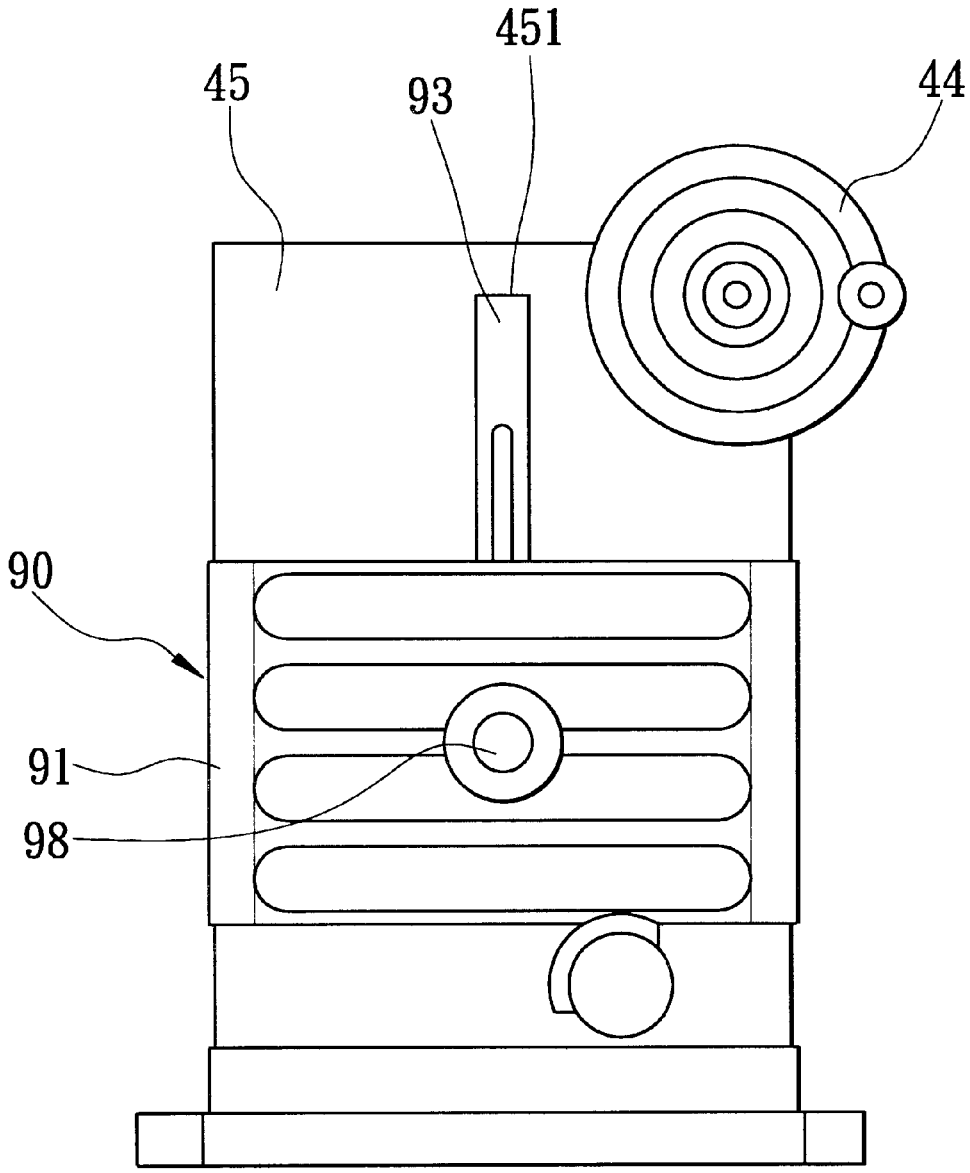
FIG. 10 is a side view of the preferred embodiment, illustrating how the cover shield is shifted relative to the side wall in order to shield the tool accommodating chamber.

Referring to FIGS. 8, 9 and 10, the preferred embodiment further includes left and right side walls 45 extending uprightly from the mounting sides of the machine base 43 and disposed outboard to the upstanding posts 42, respectively. At least one of the side walls 45 has an outer surface formed with two tool accommodating chambers 452, 453 for accommodation of tools, such as a spanner or screwdriver 110 for repairing and maintaining the planing machine. A cover shield 91 is movably and releasably mounted on the side wall 45 by means a locking unit 90 for shielding selectively the tool accommodating chambers 452, 453. The locking unit 90 includes a supporting plate 93 disposed to abut against the side wall 45, and a spring-loaded bolt 94 inserted through the supporting plate 93, a vertical slot 451 in the side wall 45, and the cover shield 91 and threaded with a nut 98. The bolt 94 can be tightened or loosened relative to the nut 98 against biasing action of the spring 95 so as to lock or unlock the cover shield 91 with respect to the side wall 45. The cover shield 91 is preferably formed with a spring holding tube 96.

With this invention thus explained, it is apparent that numerous modifications and variations can be made without departing from the scope and spirit of this invention. It is therefore intended that this invention be limited only as indicated in the appended claims.

I claim:

1. A wood planing machine comprising:

a machine base having opposite mounting sides spaced apart from each other in a transverse direction, and feed-in and take-out sides opposite to each other in a longitudinal direction;

a plurality of upstanding posts extending upward from said machine base at said mounting sides;

a cutter carriage disposed above said machine base, and having opposite end portions mounted movably on said upstanding posts for sliding movement of said cutter carriage along said upstanding posts, said cutter carriage further having a front side extending in said transverse direction and proximate to said feed-in side, a rear side opposite to said front side, and a lowermost surface extending between said front and rear sides in said longitudinal direction and cooperating with said machine base to define a workpiece passage therebetween;

a height adjusting mechanism disposed to displace said cutter carriage relative to said machine base along said upstanding posts; and a material removal indicator assembly including a ball retention groove formed in said cutter carriage and in communication with said workpiece passage, a ball member rotatably and movably disposed in said ball retention groove, and having a lowermost protruding area extending outwardly of said ball retention groove and into said workpiece passage, and an uppermost lifting area, said lowermost protruding area and said uppermost lifting area being respectively provided with lowermost and uppermost contact points that define an upright length which remains constant during rotation of said ball member relative to said ball retention groove, a pointer having a pivot portion pivotally mounted on said cutter carriage at a level above said ball retention groove, a pointing portion distal to said pivot portion, and an intermediate portion between said pivot and pointing portions and resting on said uppermost contact point and applying a downward force on said ball member such that said pointer extends in said transverse direction, and an indicia uprightly disposed on said cutter carriage, and having incremental marks pointed to by said pointing portion;

whereby, after placing a workpiece on said machine base proximate to said feed-in side, subsequent downward movement of said cutter carriage along said upstanding posts will bring said lowermost contact point to abut against the workpiece which in turn exerts a lifting force to said ball member as well as said uppermost lifting area as the downward movement of said cutter carriage continues, thereby pivoting said pointer and moving said pointing portion along said indicia to indicate a thickness value of the portion of said workpiece to be removed when said workpiece is fed through said workpiece passage.

2. The wood planing machine as defined in claim 1, wherein said material removal indicator assembly further includes a ball holding member formed as a hollow tubular body having a small-diameter section disposed fittingly in said ball retention groove to receive said ball member rotatably therein, and a large-diameter section extending uprightly from said small-diameter section and formed with a diametrically spaced pair of axially extending slots for extension of said intermediate portion of said pointer therethrough to rest on said uppermost contact point.

3. The wood planing machine as defined in claim 1, further comprising left and right side walls extending uprightly from said mounting side of said machine base and disposed outboard to said upstanding posts respectively, at least one of said left and right side walls having an outer surface formed with a tool accommodation chamber, and a cover shield detachably mounted on said at least one of said left and right side walls so as to shield said tool accommodation chamber.

4. The wood planing machine as defined in claim 3, further comprising a locking unit disposed on said cover shield and operably connected to said at least one of said left and right side walls for releasably locking said cover shield relative to said at least one of said left and right side walls.

* * * * *